US009156221B2

(12) United States Patent
Detlefsen et al.

(10) Patent No.: US 9,156,221 B2
(45) Date of Patent: Oct. 13, 2015

(54) ARRANGEMENT, SYSTEM AND METHOD FOR HANDLING NON-WOOD PLANT MATERIAL

(71) Applicant: Valmet AB, Sundsvall (SE)

(72) Inventors: Jan Detlefsen, Alnö (SE); Patrik Pettersson, Alnö (SE); Robert Wahlberg, Sundsvall (SE)

(73) Assignee: Valmet AB (SE)

( * ) Notice: Subject to any disclaimer, the term of this patent is extended or adjusted under 35 U.S.C. 154(b) by 0 days.

(21) Appl. No.: 14/380,189

(22) PCT Filed: Feb. 19, 2013

(86) PCT No.: PCT/SE2013/050140

§ 371 (c)(1),
(2) Date: Aug. 21, 2014

(87) PCT Pub. No.: WO2013/126007

PCT Pub. Date: Aug. 29, 2013

(65) Prior Publication Data

US 2015/0020700 A1 Jan. 22, 2015

(30) Foreign Application Priority Data

Feb. 22, 2012 (SE) ..... 12501607

(51) Int. Cl.
*B30B 9/16* (2006.01)
*B30B 9/12* (2006.01)
*D21C 7/06* (2006.01)

(52) U.S. Cl.
CPC . *B30B 9/16* (2013.01); *B30B 9/127* (2013.01); *D21C 7/06* (2013.01)

(58) Field of Classification Search
CPC ..... B30B 9/301; B30B 9/12; B30B 9/121; B30B 9/128; B30B 9/14; B30B 9/16; B30B 11/24; B30B 11/243; B30B 11/245; B30B 11/246; D21B 1/22
USPC ..... 100/35, 37, 117, 126, 127, 128, 145, 100/146, 150; 162/18, 236, 237; 366/76.4, 366/83
See application file for complete search history.

(56) References Cited

U.S. PATENT DOCUMENTS

| | | | | | |
|---|---|---|---|---|---|
| 2,943,012 | A | * | 6/1960 | Dunning et al. | 162/18 |
| 2,975,096 | A | | 3/1961 | Ginaven et al. | |
| 2,997,943 | A | * | 8/1961 | Zies | 100/74 |
| 3,067,462 | A | * | 12/1962 | Kullgren | 34/61 |
| 3,067,672 | A | * | 12/1962 | French | 100/75 |
| 5,320,034 | A | | 6/1994 | Eccleston | |
| 5,826,500 | A | * | 10/1998 | Kemper | 100/73 |

FOREIGN PATENT DOCUMENTS

| | | | |
|---|---|---|---|
| GB | 1421549 | A | 1/1976 |
| WO | 03013714 | A1 | 2/2003 |
| WO | 2010058285 | A2 | 5/2010 |

OTHER PUBLICATIONS

International Search Report for Application No. PCT/SE2013/050140 dated May 14, 2013.

* cited by examiner

*Primary Examiner* — Jimmy T Nguyen
(74) *Attorney, Agent, or Firm* — Lerner, David, Littenberg, Krumholz & Mentlik, LLP

(57) ABSTRACT

A feeding arrangement for feeding plant material to a treatment vessel is disclosed including a plug screw feeder, a force feeding screw for feeding the plant material to the plug screw feeder in which the force feeding screw is arranged essentially perpendicular to the plug screw, and a feeding device for feeding incoming material to the force feeding screw, and in which the plug screw can rotate at variable speed, and the force feeding screw includes when a distance between the last screw thread of the force feeding screw and the outer diameter of the plug screw is up to 90 mm.

12 Claims, 1 Drawing Sheet

ARRANGEMENT, SYSTEM AND METHOD FOR HANDLING NON-WOOD PLANT MATERIAL

CROSS-REFERENCE TO RELATED APPLICATIONS

The present application is a national phase entry under 35 U.S.C. §371 of International Application No. PCT/SE2013/050140 filed Feb. 19, 2013, published in English, which claims priority from Swedish Patent Application No. 1250160-7 filed Feb. 22, 2012, all of which are hereby incorporated herein by reference.

TECHNICAL FIELD

The present invention relates to treatment of non-wood plant material and more specifically to a feeding arrangement for feeding such plant material to a treatment vessel, a system for treatment of non-wood plant material including the feeding arrangement and a method for handling non-wood plant material.

BACKGROUND

Feeding of material to be treated in a treatment vessel may be carried out in different ways and is dependent on a number of factors such as the characteristics of the material to be fed and the possible desired action on the material beside the actual feeding thereof. Plug screw feeders, in which a rotating screw transports the material forward is a commonly used type of feeder. At the same time as the material is fed to the treatment vessel, the screw and associated screw pipe or housing also exercises a volumetric compression function. Such plug screw feeders are very commonly used for feeding wood chips to a digester or an impregnator. Commonly, such plug screw feeders also comprise a plug pipe at the end of the feeder, with an essentially constant inner diameter. The compression taking place in that part of the plug screw feeder is essentially axial.

A known problem with such plug screw feeders is that the theoretical possible compression of the material in the plug screw feeder is often not obtained. A solution to such a problem may be to "force-feed" the plug screw, i.e. making sure that material is fed to the plug screw such that a main part of the available volume in the screw housing is properly filled and thus may be compressed.

A prior art screw feeder apparatus using the principle of force-feeding is disclosed in U.S. Pat. No. 5,320,034. The known apparatus is to be used for increasing fiber dislocation of wood chips, improving a subsequent impregnation of the fiber material. By forcing material into the inlet section of the compression device (plug screw feeder) by means of a force-feeding screw, the packing density, i.e. the degree of filling, will be increased and uniform in the inlet of the plug screw. In other words, it is ensured that the plug screw feeder volume at the inlet section is filled with wood chips.

However, when dealing with other types of materials, different considerations may apply. It has been discovered that the screw feeder apparatus disclosed in U.S. Pat. No. 5,320,034 is not applicable to the feeding of non-wood plant material, such material having a much lower bulk density than wood chips, without modification.

The use of non-wood plants has recently become more and more important. In some cases the material is used as fuel for generating heat. The material may also be used for production of pulp for paper-making purposes or the like, replacing wood as the source material. In many such processes, the non-wood material is treated in a pressurized reactor, imposing special requirements on the feeding arrangement.

There is thus a need for an improved feeding arrangement suitable for the feeding of bulky non-wood plant material and accordingly a system for treatment of such material comprising such a feeding arrangement and a method for feeding non-wood plant material.

SUMMARY

An object of the present invention is to provide a feeding arrangement suitable for handling bulky non-wood plant material. Another object is to provide a feeding arrangement in which the risk of back flow of steam or the like is minimized. A further object is to provide a feeding arrangement by which it is possible to feed non-wood plant material against higher pressure, with maintained running conditions.

Another object is to provide a system for treatment of non-wood plant material in which the risk of back flow of steam or the like is minimized. A further object is to increase the capacity of a treatment system for a given size of plug screw in a feeding arrangement. Still another object is to provide a treatment system for non-wood plant material in which liquid, if applied to impregnate the non-wood plant material before it is introduced to the feeding arrangement, is evenly distributed. Yet another object is to provide a method for feeding non-wood plant material to a treatment vessel.

These and other objects are achieved in accordance with the appended claims.

For the purpose of this disclosure, the term non-wood plant material encompasses herbaceous plants, such as straw, bagasse, and wheat (bran and grain material). Peat material and empty fruit bunches are also encompassed by the term. In short, the term non-wood plant material is used for all kinds of plant/plant part containing material not being defined as wood.

The present invention is based on the recognition that a feeding arrangement suitable for the feeding of bulky non-wood plant material can be achieved by an arrangement comprising a force-feeding screw, which feeds material to a plug screw feeder, in which the distance between the force-feeding screw and the plug screw is adapted to be suitable for such material. By adjusting the rotational speed of the plug screw in relation to the production flow set by a feeding device feeding the force-feeding screw, the bulk density of the material may be increased. The rotational speed of the force-feeding screw may be set to a value ensuring that the force-feeding screw is not overly filled, i.e. does not exceed its maximum filling degree. Preferably, the rotational speed of the force-feeding screw is set to be run at overspeed, i.e. resulting in a comparatively low degree of filling. However, all the material entering into the force-feeding screw is entered (forced) into the plug screw.

In contrast to the prior art screw feeder, it is the bulk density of the material in itself that is increased in the feeding arrangement according to the invention. This is not the case in the prior art, where the force-feeding screw only facilitates an improved utilization of the volume of the inlet section of the plug screw and does not increase the bulk density of the material in that section. By selecting a rather short distance from a last screw thread of the force-feeding screw to a point on the outer diameter of the plug screw at the inlet section thereof, it is ensured that the non-wood material is efficiently fed forward in the plug screw feeder and compressed to a higher bulk density. By increasing the bulk density of the material, an essentially gas- and fluid-tight plug is formed, minimizing the risk for steam or other treatment media from the treatment vessel to be able to flow backwards, i.e. in a direction opposite to the feeding direction of the material. The term bulk density should in this context be interpreted as the density of the material whether in compressed or non-compressed state. The conventional use of the term as being defined as the density of a material at atmospheric pressure is thus not the only one encompassed for the purpose of this disclosure.

More specifically, a feeding arrangement for feeding non-wood plant material, having a bulk density of 40-90 kg/m$^3$, to a treatment vessel is provided wherein the feeding arrangement comprises a plug screw feeder for feeding the plant material to the treatment vessel, the plug screw feeder comprising a plug screw with a corresponding plug screw housing surrounding the plug screw, a force-feeding screw for feeding incoming material to the plug screw feeder, the force-feeding screw being arranged to provide the material to an inlet section of the plug screw, a feeding device being arranged to feed incoming material to the force-feeding screw, where a distance between a outermost point of a last screw thread of the force-feeding screw to a point on the outer diameter of the plug screw at the inlet section is 0-90 mm. The distance may preferably be between 10-70 mm. By having such a comparatively small distance, it is ensured that the bulky material from the force-feeding screw enters the plug screw in a steady flow and is efficiently fed forward. Distances within the interval may be chosen in relation to a largest dimension of a particle of the non-wood material, the smaller the particle—the shorter the distance to be chosen.

According to one embodiment, the force-feeding screw may be arranged essentially perpendicular to the plug screw, meaning that their respective rotational axes are essentially perpendicular to each other. In one embodiment the force-feeding screw is arranged in such a way that the material is fed to the plug screw feeder from the side, i.e. a transverse feed into the plug screw feeder in relation to its feeding direction.

According to one embodiment, the plug screw is adapted to be able to be rotated at variable speed in relation to a production flow rate set by the feeding device. In another embodiment, the force-feeding screw is adapted to be kept at a constant speed, the constant speed being chosen such that the force-feeding screw has a predetermined degree of filling below the maximum degree of filling. It is important to note that it is the relationship between the production flow rate set by the feeding device and the rotational speed of the plug screw that determines the density increase obtained.

The invention also covers a system for treatment of non-wood plant material, comprising the feeding arrangement and a treatment vessel, in which the non-wood plant material is to be treated, e.g. by addition of reactant chemicals and a method for handling non-wood plant material using the feeding arrangement.

In a preferred embodiment, the feeding arrangement according to the invention is utilized in connection with a pressurized treatment vessel posing special requirements on its feeding arrangement. By the term pressurized is meant that the pressure in the treatment vessel exceeds atmospheric pressure. When feeding to a pressurized treatment vessel the feeding arrangement must be adapted in such a way that a back flow of high-pressure steam or treatment media from the treatment vessel is avoided or at least minimized.

For such applications it is of outermost importance that the material in the plug screw is fully compressed to minimize the risk of high pressure steam going the wrong direction, i.e. backwards in relation to the feeding direction of the non-wood plant material.

BRIEF DESCRIPTION OF THE DRAWINGS

The invention, together with further objects and advantages thereof, may best be understood by reference to the following description and appended drawings, in which.

DETAILED DESCRIPTION

Figure 1:
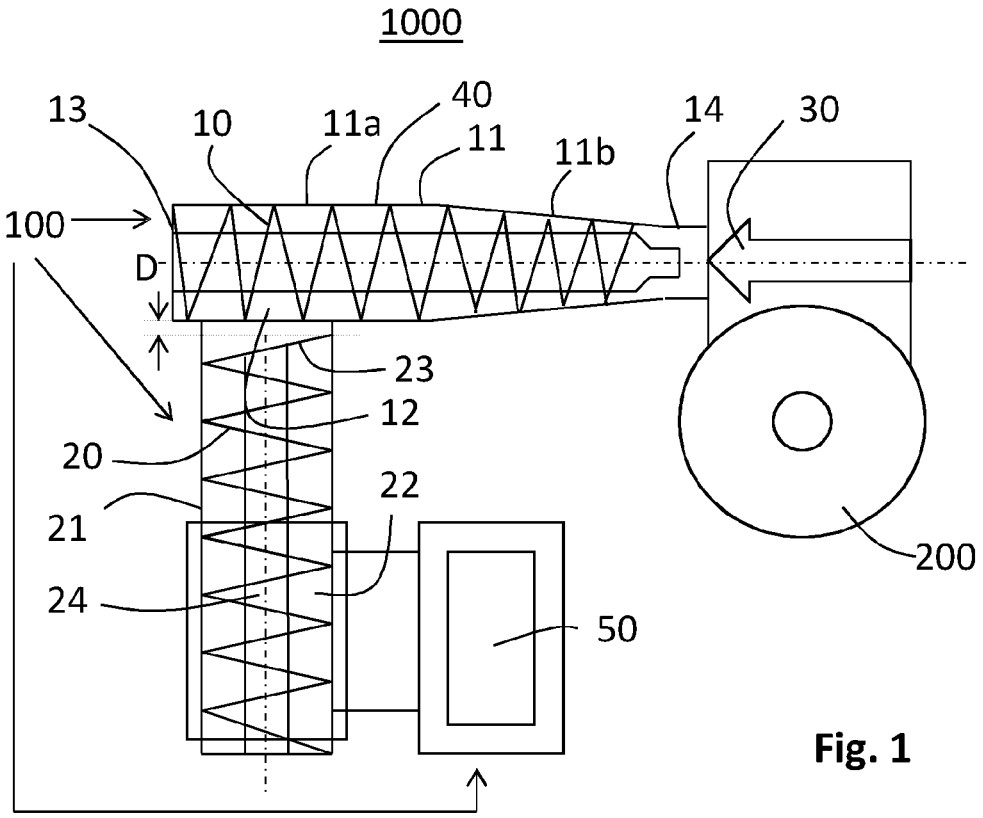
FIG. 1 is a schematic cross-sectional top view illustrating an example system for treatment of non-wood pulp according to the invention.

In the drawings, similar or corresponding elements are denoted by the same reference numbers.

For the purpose of this disclosure, the term longitudinal is meant to be the direction along which a body or part has its greatest extension. When the term is used in connection with the axes of screws, the longitudinal axis corresponds to the rotational axis of the screw.

FIG. 1 is a schematic cross-sectional top view illustrating an example system for treatment of non-wood pulp, comprising a feeding arrangement according to an exemplifying embodiment of the invention.

The system 1000 comprises a feeding arrangement 100 for feeding material to a treatment vessel 200. The feeding arrangement 100 comprises a force-feeding screw 20 disposed within a force-feeding screw housing 21 and a plug screw feeder 40, the plug screw feeder comprising a plug screw 10 disposed within a plug screw housing 11 and a subsequent plug pipe 14 The plug screw housing 11 comprises at least two parts, a first screw housing part 11*a* and a screw pipe 11*b*. The screw pipe 11*b* has a somewhat decreasing diameter in order to create a volumetric compression, while the plug pipe 14 has an essentially constant diameter in which mainly an axial compression takes place. The plug screw 10 may reach into at least a part of the plug pipe 14, and the plug pipe 14 could thus be considered also to be a part of the screw housing 11 surrounding the plug screw 10. The force feeding screw 20 and its housing 21 are arranged with the rotational axis of the force-feeding screw essentially perpendicular to the rotational axis of the plug screw and its housing, so that the material is fed to the plug screw 10 from the side, to an inlet section 12 of the plug screw feeder 40. In the illustrated embodiment the inlet section is in the region of a first end 13 of the plug screw 10. It should however be noted that the inlet section may be placed at a location further downstream, in the feeding direction of the plug screw 10.

The force-feeding screw 20 is arranged to be rotatable at variable rotational speeds. The plug screw 10 is also arranged to be able to rotate at variable speed, the speeds of the plug screw 10 and the force-feeding screw 20 being variable independently of each other. The force-feeding screw is preferably arranged to be run at overspeed, i.e. at a speed resulting in a low degree of filling. In any case, the rotational speed should not be low enough to overfill the force-feeding screw. According to one embodiment, the force-feeding screw 20 and associated housing 21 may be a plug screw feeder performing a pre-compression.

The feeding arrangement further comprises a feeding device 50 feeding material into the force-feeding screw 20.

The feeding device sets a predetermined rate of material flow, i.e. the production flow. The rotational speed of the plug screw 10 is then set in relation to the predetermined rate of material flow in order to achieve a predetermined density increase of the material in the plug screw. The feeding device may for example be a band conveyor. If the production flow is increased, the rotational speed of the plug screw 10 has to be increased to maintain the same density in the plug screw feeder 40. If the rotational speed of the plug screw 10 is maintained while the production flow increases, the density will increase. By increasing the material density in the plug screw feeder an essentially gas- and fluid-tight plug flow of the non-wood annular material is created through the plug screw feeder 40.

In one embodiment, the feeding device 50 is a so called pin drum feeder. A pin drum feeder comprises two drums equipped with protruding pins, the drums being arranged to co-rotate with respect to each other and in that way transporting the material forward (i.e. in a downward direction). The pin drum feeder is considered to be the "gas pedal" of the system, controlling the production capacity. When the force-feeding screw is arranged to be run at overspeed, the production volume may not be controlled by adjusting the speed of the force-feeding screw. The pin drum feeder thus ensures that an adequate amount of material is supplied to the force-feeding screw. The pin drum feeder is especially usable in connection with straw and bagasse and similar feed raw materials, having a longitudinal dimension far exceeding its transverse extension.

In an embodiment where the force-feeding screw is a plug screw feeder, this plug screw feeder may be operated in such a way as to the replace the feeding device 50 in its function as a "gas pedal".

The plug screw 10 and the force-feeding screw 20 are preferably arranged perpendicular to each other, i.e. having their respective rotational axes perpendicular to each other. In a preferred embodiment, they are arranged with their respective axes essentially in the same horizontal plane, so that the non-wood plant material is fed to the plug screw from the side. Preferably, the inlet section 12 is located close to a first end 13 of the plug screw 10, the first end being the one furthest away from the treatment vessel 200.

Illustrated in the system in the figure is further a plug breaker device 30 at the outlet of the plug screw feeder 40 after the plug pipe 14. It should be noted that this device 30 has an important safety function by acting as a check valve in the event that the plug should be lost, i.e. the flow of material not behaving as a plug. The force from the plug breaker also influences the axial compression and thus the bulk density of the material within the plug screw feeder 40. The higher the plug breaker pressure, the higher the bulk density of the material.

In operation, non-wood plant material is supplied to the feeding device 50, the feeding device in turn feeding the material into an inlet section 22 of the force-feeding screw 20 which is operated at a comparatively high rotational speed, ensuring that the force-feeding screw will not become overfilled.

The non-wood plant material is force-fed to the plug screw feeder 40 at the inlet section 12 and transported by the rotation of the plug screw 10 towards the treatment vessel 200. The treatment vessel may be a reactor suitable for the desired treatment, such as e.g. a digester or a horizontal reactor. The reactor may be pressurized, i.e. adapted to operate at a pressure exceeding the atmospheric pressure. Preferably, the reactor operates at an overpressure of 4-40 bars, i.e. 5-41 bars absolute pressure. One type of a horizontal reactor especially suitable for non-wood plant material comprises a rotating screw, disposed within an essentially cylindrical housing, conveying the material towards the discharge end of the reactor.

The feeding arrangement of the present invention is especially advantageous when feeding material to a pressurized reactor, since the gas and fluid-tight plug created by the density increase of the material minimizes the risk of back-flow of steam or other reactant chemicals from the reactor. Due to the higher compression ratio, it is possible to feed against a higher pressure.

Figure 2:
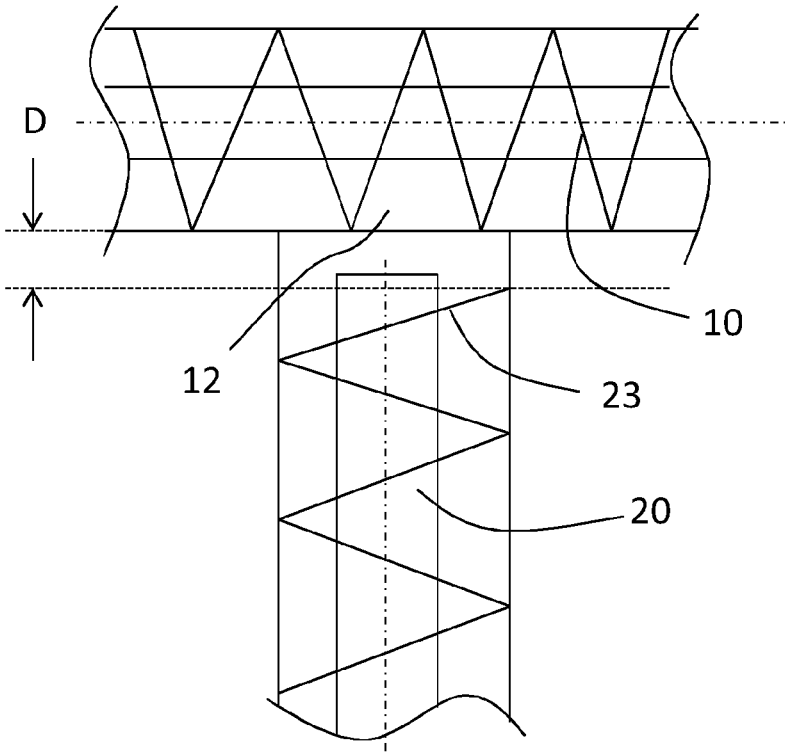
FIG. 2 is an enlargement of the area where the force-feeding screw and the plug screw feeder are connected, according to another exemplifying embodiment of the invention.

FIG. 2. illustrates, in enlargement compared to FIG. 1, the area where the force-feeding screw 20 is connected to the plug screw feeder 40 at an inlet section 12 thereof. The distance D of importance is between the outermost part of the last thread 23 of the force-feeding screw 20 and an outer diameter of the plug screw 10. In the illustrated embodiment, the axle or shaft 24 of the force-feeding screw is arranged to have an extension exceeding the total length of the threaded section. However, preferably, the end of the threaded section will coincide with the end of the axle or shaft 24 of the force-feeding screw, as illustrated in FIG. 1, although very schematically. It is also preferable that the screw pipe 21 surrounding the force-feeding screw 20 has an extension corresponding to the extension of the screw 20.

The distance D between the force-feeding screw 20 and the plug screw 10 is to be chosen in relation to the particle size. It is not just the particle size as such, but also the characteristics of the material to be fed, such as its ability to "drag along its co-particles", that matters. The hydraulic diameter, i.e. the ratio between the particle volume and its area, is one parameter that may be used for determining the distance to be used for a specific material. However, it has been discovered that the largest dimension of a particle may be used to adequately determine which distance to be chosen.

The particle dimensions may range in the interval of 5-50 mm. For a material in which the average largest dimension of particles is in the lower range of the interval, a distance in the lower range of the interval 0-90 mm is to be chosen. The average largest dimension L in this respect is defined as the "length weighted average particle length" according to below definition, $$L(l)=\Sigma(l_i^{2}*n_i)/\Sigma(l_i*n)$$

where $l_i$ is the largest dimension of a particle i and n is the number of particles i.

For example, when feeding straw with a relatively large average largest dimension, a distance of 70 mm was used, while when feeding peat, a plant material with a relatively small particle size, the shorter distance of 10 mm was used. The average longest particle dimension for the straw material was about 15 mm while for the peat material, the corresponding dimension was about 1 mm.

In case the distance is too long for the specific material being fed, the material will not be "pulled along" by the plug screw, which will obstruct the material flow in the feeding arrangement.

In the method for treatment of non-wood plant material using a feeding arrangement according to the invention, a distance D between the plug screw 10 and the force-feeding screw 20 is set to a distance within the interval of 0-90 mm, preferably 10-70 mm. The distance is chosen within the interval depending on the characteristics of the material, for example represented by the average length of the particles. The feeding device 50 is set to feed a predetermined flow of plant material, and the rotational speed of the plug screw 10 is chosen in relation to the rate of predetermined flow of plant material such that a predetermined density increase is achieved.

According to one embodiment, the speed of the force-feeding screw 20 is set at a constant speed, chosen such that the force-feeding screw 20 has a predetermined degree of filling, the predetermined degree of filling being below the maximum degree of filling.

Although the invention has been described with reference to specific illustrated embodiments, it is emphasized that it also covers equivalents to the disclosed features, as well as changes and variants obvious to a man skilled in the art, and the scope of the invention is only limited by the appended claims.

The invention claimed is:

1. A feeding arrangement for feeding non-wood plant material having a bulk density of 40-90 kg/m$^3$ to a treatment vessel, the feeding arrangement comprising a plug screw feeder including an inlet section for feeding the plant material to the treatment vessel, the plug screw feeder comprising a plug screw having a longitudinal axis and a corresponding plug screw housing surrounding the plug screw, a force-feeding screw including a longitudinal axis for feeding the plant material to the plug screw feeder and a corresponding force-feeding screw housing surrounding the force-feeding screw, the force-feeding screw being arranged to provide the material to the inlet section of the plug screw feeder, wherein the longitudinal axis of the force-feeding screw is arranged essentially perpendicular to the longitudinal axis of the plug screw, and a feeding device for feeding incoming material to the force-feeding screw wherein the plug screw is capable of rotating at variable speed in relation to a production flow rate set by the feeding device, said force-feeding screw including a distance (D) between an outermost point of a last screw thread, as seen in the direction of the longitudinal axis of the force-feeding screw, the distance (D) between an outermost point of said last screw thread of the force-feeding screw to a point on the outer diameter of the plug screw at the inlet section of the plug screw feeder being up to 90 mm.

2. The feeding arrangement according to claim 1, wherein the distance (D) is from 10 to 70 mm.

3. The feeding arrangement according to claim 1, wherein the force-feeding screw is arranged essentially in the same horizontal plane as the plug screw, the force-feeding screw feeding the material to the side of the plug screw.

4. The feeding arrangement according to claim 1, wherein the force-feeding screw is adapted to be kept at a constant speed, the constant speed being chosen such that the force-feeding screw has a predetermined degree of filling below the maximum degree of filling.

5. The feeding arrangement according to claim 1, wherein the feeding device is a pin drum feeder.

6. A system for treatment of non-wood plant material, comprising the feeding arrangement of claim 1 and a treatment vessel to which the feeding arrangement is arranged to feed the material to be treated.

7. The system for treatment of non-wood plant material according to claim 6, wherein the treatment vessel operates at an overpressure of from 4 to 40 bars.

8. The system for treatment of non-wood plant material according to claim 6, wherein the treatment vessel is a digester.

9. The system for treatment of non-wood plant material according to claim 6, wherein the treatment vessel is a horizontal reactor.

10. A method for treatment of non-wood plant material using a feeding arrangement according to claim 1, wherein a distance between an outermost point of the last screw thread of the force-feeding screw, as seen in the direction of the longitudinal axis of the force-feeding screw, to a point on the outer diameter of the plug screw at the inlet section of the plug screw feeder is set to a distance within the interval of from 0 to 90 mm, wherein the feeding device is set to feed a predetermined flow of plant material, and the rotational speed of the plug screw is chosen in relation to the rate of predetermined flow of plant material by the feeding device to the force-feeding screw, such that a predetermined density increase is achieved.

11. The method according to claim 10, wherein the speed of the force-feeding screw is set at a constant speed, chosen such that the force-feeding screw has a predetermined degree of filling, the predetermined degree of filling being below the maximum degree of filling.

12. The method according to claim 10, wherein the distance (D) is set at an interval of from 10 to 70 mm.

* * * * *